US006881299B2

(12) United States Patent
Parrish et al.

(10) Patent No.: US 6,881,299 B2
(45) Date of Patent: Apr. 19, 2005

(54) REFINER BLEACHING WITH MAGNESIUM OXIDE AND HYDROGEN PEROXIDE

(75) Inventors: Anthony Parrish, Kalama, WA (US); Roger O. Campbell, Federal Way, WA (US); Raymond E. Harrison, Longview, WA (US); Paul B. Mobley, Kalama, WA (US); Gregg McCarthy, Vancouver, WA (US)

(73) Assignee: North American Paper Corporation, Longview, WA (US)

( * ) Notice: Subject to any disclaimer, the term of this patent is extended or adjusted under 35 U.S.C. 154(b) by 0 days.

(21) Appl. No.: 10/731,359

(22) Filed: Dec. 9, 2003

(65) Prior Publication Data

US 2004/0112557 A1 Jun. 17, 2004

Related U.S. Application Data

(63) Continuation-in-part of application No. 09/860,025, filed on May 16, 2001, now Pat. No. 6,743,332.

(51) Int. Cl.[7] ..... D21C 9/16

(52) U.S. Cl. ..... 162/78; 162/55; 162/26; 162/71; 162/24; 162/90; 8/109; 8/110; 8/111

(58) Field of Search ..... 162/78, 55, 26, 162/71, 24, 90; 8/109, 110, 111

(56) References Cited

U.S. PATENT DOCUMENTS

| | | | | | |
|---|---|---|---|---|---|
| 4,106,979 | A | | 8/1978 | Ruffini et al. | |
| 4,270,976 | A | | 6/1981 | Sandstrom et al. | |
| 4,311,553 | A | | 1/1982 | Akerlund et al. | |
| 4,363,699 | A | | 12/1982 | DeCeuster et al. | |
| 4,626,319 | A | * | 12/1986 | Kruger et al. | 162/65 |
| 4,675,076 | A | | 6/1987 | Darlington | |
| 4,718,980 | A | | 1/1988 | Lowrie et al. | |
| 4,731,160 | A | * | 3/1988 | Prough et al. | 162/55 |
| 4,804,440 | A | | 2/1989 | Liebergott et al. | |
| 4,812,206 | A | | 3/1989 | Devic et al. | |
| 5,129,987 | A | * | 7/1992 | Joachimides et al. | 162/25 |
| H1690 | H | | 11/1997 | Nye | |
| 6,056,853 | A | * | 5/2000 | Vincent et al. | 162/78 |
| 6,398,908 | B1 | | 6/2002 | Hermansson et al. | |
| 6,524,437 | B1 | * | 2/2003 | Vincent et al. | 162/49 |
| 2001/0050153 | A1 | * | 12/2001 | Wajer et al. | 162/72 |

FOREIGN PATENT DOCUMENTS

| | | | |
|---|---|---|---|
| AU | A 41044/99 | A1 | 10/2000 |
| CA | 2278399 | A1 | 1/2000 |
| WO | WO 96/41917 | A1 | 12/1996 |

OTHER PUBLICATIONS

Anderson, J.R., and B. Amini, "Chap. 10: Hydrogen Peroxide Bleaching, " in C.W. Dence and D.W. Reeve (eds.), *Pulp Bleaching: Principles and Practice, Section IV: Chemical Pulp Bleaching*, TAPPI Press, Atlanta, 1996; pp. 411–442.

Arnevik, T.A., and N. Soteland, "Peroxide Bleaching of Mechanical Pulps at High Consistency," *Proceedings of International Mechanical Pulping Conference*, Helsinki, Jun. 6–8, 1989, pp. 201–212.

Bambrick, D.R., "The Effect of DTPA on Reducing the Peroxide Comsumption," *TAPPI* 68:96–100, 1985.

Dionne, P.Y., et al., "Soda Ash and Magnesium Oxide—Alkali Sources for the Bleaching of Mechanical Pulp, " *Paper Technology*, Apr. 1995, pp. 29–34.

Dionne, P.Y., et al., "The Use of Soda Ash and Magnesium Oxide as Alkali Sources for the Hydrogen Peroxide Bleaching of Mechanical Pulp," *The 18th International Mechanical Pulping Conference*, Oslo, Norway, Jun. 15–17, 1993, pp. 403–408.

Hill, R., et al., "High Temperature Peroxide Bleaching of Mechanical Pulps," *Pulping Conference Book 1*, Nashville, Tennessee, Oct. 27–31, 1996, pp. 349–360.

Kuczynski, K., et al., "DTPMPA: Polyamino Polyphosphonic Acid and Its Use in Paper Processes," *TAPPI* Journal 71:171–174, 1988.

Künzel, U., et al., "Smoothing the Way," *Paper*, Apr. 1993, pp. 30–33.

Kutney, G.W., and T.D. Evans, "Peroxide Bleaching of Mechanical Pulps: Part 2. Alkali Darkening–Hydrogen Peroxide Decomposition," *Svensk Papperstidn* 88:R84–R89, 1985.

Ni, Y., et al., "Improved Transition Metal Removal in a Reducing Agent– Assisted Chelation Stage: A Laboratory Study," *Pulp Pap. Can.* 99:77–79, 1998.

Nyström, M., et al., "Peroxide Bleaching of Mechanical Pulp Using Different Types of Alakli," *Paperi Ja Puu*75:419–425, 1993.

Prasakis, J., et al., "Metal Management Improves Peroxide Bleaching of TMP," *TAPPI* 79:161–166, 1996.

Presley, J.R., and R.T. Hill, "Chap. 1: Peroxide Bleaching of (Chemi)mechanical Pulps," in C.W. Dence and D.W. Reeve (eds.), *Pulp Bleaching: Principles and Practice, Section V: The Technology of Mechanical Pulp Bleaching*, TAPPI Press, Atlanta, 1996, pp. 457–489.

Pykäläinen, J., et al.,"COD Decrease With New Alkalis in Peroxide Bleaching of Mechanical Pulps," *Proceedings of the 18th International Mechanical Pulping Conference*, Oslo, Norway, Jun. 15–17, 1993, pp. 154–157.

Soteland, N., et al., "Use of MgO and CaO as the Only Alkaline Source in Peroxide Bleaching of High–Yield Pulps," *Proceedings of the International Pulp Bleaching Conference*, Orlando, Florida, 1988, pp. 231–236.

Stark, H., and M.H. Diehold, "High Temperature Bleaching of Wood Pulps by Hydrogen Peroxide," *Wocheshlatt für Papierfabritation*17(21):959–962, 1989.

* cited by examiner

*Primary Examiner*—Charles Boyer
(74) *Attorney, Agent, or Firm*—Christensen O'Connor Johnson Kindness PLLC

(57) ABSTRACT

Methods of bleaching mechanical pulp under alkaline conditions with hydrogen peroxide. The methods include introducing a source of magnesium ions and hydroxyl ions to a refiner. The wood particulates are refined into a pulp in the presence of the magnesium ions and hydroxyl ions, and optionally perhydroxyl ions to simultaneously refine and bleach the pulp in a refiner.

27 Claims, 2 Drawing Sheets

REFINER BLEACHING WITH MAGNESIUM OXIDE AND HYDROGEN PEROXIDE

CROSS-REFERENCE TO RELATED APPLICATION

This application is a continuation in part of U.S. application Ser. No. 09/860,025, filed on May 16, 2001, now U.S. Pat. No. 6,743,332 incorporated herein by reference in its entirety.

FIELD OF THE INVENTION

The present invention is related to methods of alkaline bleaching of pulps with magnesium oxide and hydrogen peroxide.

BACKGROUND OF THE INVENTION

Mechanical pulping is a process of mechanically triturating wood into fibers for the purpose of making pulp. Mechanical pulping is attractive as a method for pulping because it achieves higher yields as compared with chemical pulping since lignin is retained to a large degree in mechanically pulped woods. Pulps made using any of the conventional mechanical pulping methods are mainly used for newsprint and printing papers but are typically unsuitable for high quality or durable paper products. This is due, in part, to the fact that high yield mechanical pulps are generally more difficult to bleach than chemical pulps because of the high lignin content.

There are many types of mechanical pulping, including stone grinding (SG), pressurized stone grinding (PSG), refiner mechanical pulping (RMP), thermomechanical pulping (TMP), and chemi-thermomechanical pulping (CTMP). The latter three can further be grouped generally under refiner pulping processes. In RMP, wood chips are ground between rotating metal disks. The process usually is carried out in two stages. The first stage is mainly used to separate the fibers, while the second stage is used to treat the fiber surface for improved fiber bonding of paper products. In RMP, the wood chips are refined at atmospheric pressure in both a first and a second stage refiner. The refiner processes generate heat by the friction of the metal disks rubbing against the wood. The heat is liberated as steam, which is often used to soften the incoming chips.

TMP differs from RMP in that the pulp is processed in a pressurized refiner. In the TMP process, two stages are normally used also. The first stage refiner operates at an elevated temperature and pressure, and the second stage refiner is typically at or near atmospheric pressure. Pulps made by a TMP process have high strength, which makes the TMP process the most favored mechanical pulping process. However, there is still room for improving the TMP process. The TMP process consumes large amounts of energy, and the pulp produced by the TMP process tends to be darker than most other pulps. Alkaline bleaching of mechanical pulps produced by the TMP process has been carried out using oxidative reagents, such as hydrogen peroxide. Sodium hydroxide is a strong alkali that provides the requisite high pH necessary to produce the active perhydroxyl ion, $HOO^-$, thought to be the agent primarily responsible for bleaching.

U.S. Pat. No. 4,270,976 to Sandstrom et al., is representative of a TMP process used to produce peroxide bleached, mechanical pulp by introducing a peroxide containing bleaching solution into the grinding space of a refiner. The conventional alkalinity in the Sandstrom patent is supplied by caustic (sodium hydroxide). Sodium hydroxide requires the use of sodium silicate, which 1) acts as a pH buffer for the sodium hydroxide and 2) helps in stabilizing the peroxide. The peroxide bleaching causes oxalate formation. The highly dissolved alkali concentration with sodium hydroxide and sodium silicate promotes oxalate scale deposits on the refiner plates, interfering with the operation and efficiency of the refiner. Oxalate scale can even be present in the finished paper products. Refiner bleaching using sodium hydroxide and sodium silicate causes refiner plate filling, erratic refiner load, and "slick" pulp resulting in inadequate refining of the wood. The use of sodium silicate also requires separate facilities to store the chemical and pumps to meter the correct dosage. Darkening of the pulp can be attributed to the addition of excess quantities of sodium hydroxide. The aforementioned problems illustrate that refiner bleaching with sodium hydroxide and sodium silicate has many drawbacks that make commercial use difficult and expensive.

Accordingly, there is a need to find alternative methods of refiner bleaching that cures many of the aforementioned problems with using sodium hydroxide and sodium silicate.

The prior U.S. application Ser. No. 09/860,025, filed May 16, 2001, incorporated herein by reference in its entirety, and assigned to the assignee of the present application, describes using substitute alkaline chemicals for sodium hydroxide. The present application further adds to the methods of the '025 application.

SUMMARY OF THE INVENTION

The present invention is related to methods of bleaching pulp under alkaline conditions with hydrogen peroxide. The methods include introducing a source of magnesium ions and hydroxyl ions, and a source of perhydroxyl ions, to a refiner. The wood particulates are refined into a pulp in the presence of the magnesium ions, hydroxyl ions, and perhydroxyl ions, to simultaneously refine and bleach the pulp in a refiner. The source of perhydroxyl ions can be added concurrently with the source of magnesium ions and hydroxyl ions, or the source of perhydroxyl ions can be added to a vessel containing the refined pulp after refining takes place. The refiner to which sources of magnesium ions, hydroxyl ions, and perhydroxyl ions are added can be any refiner in a mechanical pulp mill. Any one or all of the refiners in a mill can be supplied with the source of magnesium ions and hydroxyl ions and the source of perhydroxyl ions. For example, the refiner can be either one or both of the primary pressurized refiner and the secondary atmospheric refiner in a two-stage refining process used for thermal mechanical pulp production. The present invention is not, however, limited to a two-stage process, but can be applied to any high consistency refining process. A source of magnesium and hydroxyl ions is magnesium oxide and water. A source of perhydroxyl ions is hydrogen peroxide.

It is well documented that increasing alkalinity can have a positive influence on the tensile strength of pulp. The alkalinity is traditionally achieved using sodium hydroxide. Most mills can not add the sodium hydroxide to the refiner due to the detrimental effects that can occur, such as plate filling and erratic refiner operation. Magnesium hydroxide appears to give the same tensile strength improvement as sodium hydroxide and has other related advantages. Addition of magnesium hydroxide directly at or before the refiner does not exhibit the same problems observed with sodium hydroxide.

Peroxide bleaching with sodium hydroxide/sodium silicate chemicals generates calcium oxalate scale when the oxalate ion combines with calcium in the process water or from the wood. The scale forms tenacious deposits on the equipment. The scale can end up in the finished paper product and cause problems with the paper press. Magnesium ions, on the other hand, react with oxalate ions to form magnesium oxalate that is more soluble than calcium oxalate, thus reducing scale. The result is the reduction or elimination of scale control chemicals or other expensive preventative measures.

Magnesium oxide/hydroxide and hydrogen peroxide bleaching has the advantage of eliminating the use of sodium silicate. The high anionic charge associated with sodium silicate interferes with downstream paper machine retention aid chemistry. Silicates along with other process materials contribute to the conductivity and negative charge of the water. The elimination of sodium silicate should result in improved paper machine retentions, and allow for retention aid optimization.

Using a magnesium oxide and water slurry as the substitute for sodium hydroxide and sodium silicate in a refiner lowers bleaching times and reduces cost. Magnesium oxide and magnesium hydroxide are safe and nonhazardous and will not cause chemical burns. Magnesium hydroxide is classified as a weak base, so it buffers the bleaching reaction to a lower pH, minimizing the darkening reaction seen with sodium hydroxide. Other benefits of using a magnesium oxide and water slurry in a refiner include a reduction in the refining energy. Refiner bleaching with magnesium oxide/water slurry and hydrogen peroxide can be practiced in each stage of refining or in all refining stages. The present invention encompasses high, medium, and low consistency refining. The present invention can be applied to any refiner bleaching process. The methods described herein can be used for high consistency mechanical pulps, as well as recycled pulps from post consumer sources, and chemical pulps, such as Kraft and sulfite pulps that are processed through a refiner. The latter recycled pulps and chemical pulps are typically low to medium consistency processes. The raw material to be refined can include hardwoods and softwoods. The methods described herein can be used in processes of making thermal mechanical pulp, refiner mechanical pulp, and ground wood pulp.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
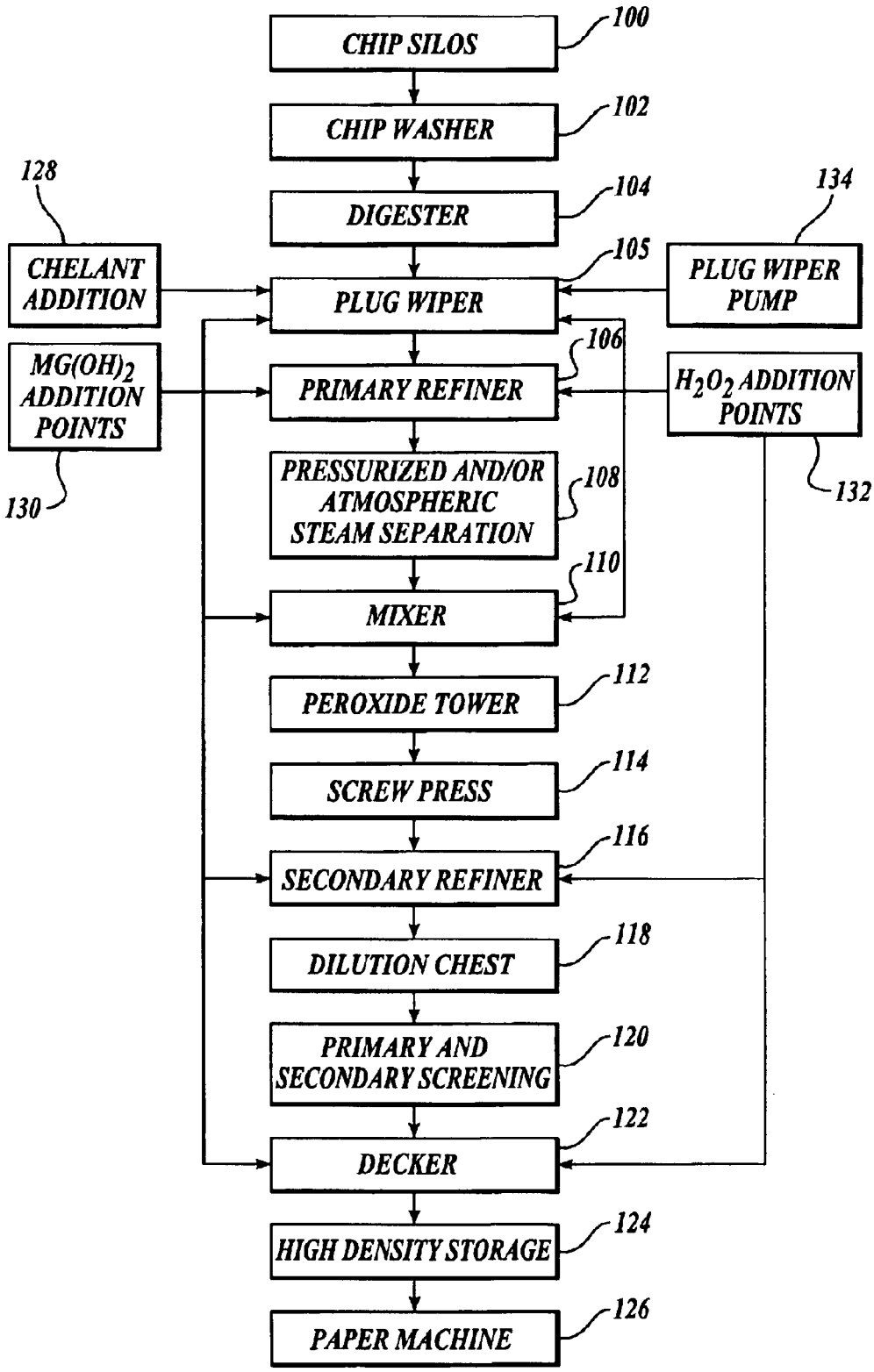
FIG. 1 is a schematic illustration showing one embodiment of a method according to the present invention.

Referring now to FIG. 1, a representative method according to the present invention is schematically illustrated. A two-stage refining system with associated unit operations, including a bleaching tower between the primary and the secondary refiner, is represented.

Block 100 represents a suitable supply of wood particulates, such as wood chips coming from chip storage silos. Wood chips suitable for use in the present invention can be derived from softwood tree species such as, but not limited to: fir (such as Douglas fir and balsam fir), pine (such as Eastern white pine and Loblolly pine), spruce (such as white spruce), larch (such as Eastern larch), cedar, and hemlock (such as Eastern and Western hemlock). Examples of hardwood tree species include, but are not limited to: acacia, alder (such as red alder and European black alder), aspen (such as quaking aspen), beech, birch, oak (such as white oak), gum trees (such as eucalyptus and sweet gum), poplar (such as balsam poplar, Eastern cottonwood, black cottonwood, and yellow poplar), gmelina, maple (such as sugar maple, red maple, silver maple, and big leaf maple). Hemlock and pine tree species are preferred for their availability and cost.

The wood chips coming from storage silos are washed in a washing apparatus represented by block 102. Washing removes any grit or debris present in the chips that can damage the refiner and cause premature wear of the plates. The chip washer receives hot water from steam producers and steam users within the mill, and thus can operate at a temperature of about 100° F. to about 150° F.

After the chip washer, a digester or "preheater," represented by block 104, is provided. Digesters expose the wood chips to steam to soften the lignin in the wood. Operating conditions in the digester are dependent on the wood chip species, and size. On hemlock wood chips of typical size, for example, the digester can operate at a pressure of about 38 psig and a retention time period of about 2 to about 4 minutes. Digesters or "preheaters" are common in mechanical refining mills. In one embodiment, the digester uses steam recovered from a downstream cyclone separator and/or steam from a make up line to heat the wood chips prior to feeding into a primary refiner. Softening the lignin in the chips conserves energy in the refining stages.

A plug wiper pump, represented by block 132, adds water to the softened wood chips via a plug wiper, block 105, prior to refining, to control the consistency at about 50%. "Consistency" as used herein refers to the ratio of solids to liquids expressed as a percentage.

A primary refiner, designated as block 106, is provided after the digester. The primary refiner is a pressurized refiner that can operate in the range of from slightly above atmospheric pressure to several tens of pounds per square inch of pressure. Typical operating pressure is about 10 psig to about 40 psig, but may be higher or lower. Secondary and/or any other additional refiners can operate at near atmospheric or above atmospheric pressures. In one embodiment, the primary refiner can operate at a pressure of about 38 psig. One or more refiners are common in mechanical pulp refining mills.

A refiner is an apparatus that mechanically separates the wood into its constituent fibers resulting in liberation of the single fiber cellulosic pulp. There are two principal types of refiners: disc refiners and conical refiners. Either is suitable to be used in the present invention. Refining adds a substantial amount of heat to the wood chips from the friction generated by the rotating plates. The heat is liberated in the form of steam in a downstream separator. The steam is collected from the separator and can be used in steam users, such as the digester, for energy conservation purposes. In addition, the condensate from the digester can be used in the chip washer.

According to the invention, a source of magnesium ions and hydroxyl ions is provided to a refiner. A source of perhydroxyl ions is provided to the refiner, as well. It has been discovered that refiners are especially suited for hydrogen peroxide and magnesium oxide/water slurry bleaching. Magnesium oxide is not readily soluble in water. The magnesium oxide is naturally buffered to maintain a comparatively lower pH than sodium hydroxide. Thus, alkali darkening of pulps is less frequent with magnesium oxide than with sodium hydroxide. The high temperatures and mechanical action in the refiner liberate the hydroxyl ions from the magnesium hydroxide, as necessary, to form the perhydroxyl ions, the agent primarily responsible for the bleaching reaction. The high shear, turbulent mixing and high temperatures provided by the refiner liberate the hydroxyl ions from the nearly insoluble magnesium hydroxide and/or magnesium oxide. Refiners also behave as mixers. High concentrations of hydrogen peroxide can be added allowing bleaching at high consistency. Bleaching at high consistency improves the overall brightness efficiency. Divalent magnesium ions complex and react differently with inorganic compounds as compared to monovalent sodium ions, including inhibiting scale formation.

The load on the refiner is generally expressed in terms of work performed on the pulp. Loads can be reduced with the use of magnesium hydroxide because magnesium hydroxide can be added at or before the refiner, which cannot be done with sodium hydroxide. The alkalinity causes swelling of the fibers that facilitates their separation thus, reducing load. A typical load on the refiner when using hydrogen peroxide and magnesium oxide bleaching is about 500 to about 2000 kilowatt-hours per ton of pulp.

The refined wood chips leaving the primary refiner, now called pulp, have a Canadian Standard Freeness value of about 400 to about 600 and a consistency ranging from about 15% to about 50%. The primary refiner can operate at a high consistency, which is typically understood to be about 20% or greater. However, the methods according to the present invention can be practiced in medium and low consistency processes. Medium consistency is typically about 10% to about 20% and low consistency is less than 10% and as low as about 3%. It is believed that the use of magnesium oxide and hydrogen peroxide in low and medium consistency processes would be less efficient in terms of chemical usage as compared with the high consistency processes. Nevertheless, use of the present invention in any medium and low consistency process would still provide some advantages over using sodium hydroxide.

The pressure is reduced after the primary refiner, which results in separation of the heat and water from the pulp via steam production. The separation operation, generally represented by block 108, can operate as one or a series of pressurized and/or atmospheric pressure vessels.

In one embodiment, the separator is a cyclone separator operated at normal atmospheric pressure or at a pressure slightly higher than atmospheric pressure. The steam generated by the drop in pressure from the primary refiner to the separator can be used in the digester, block 104. Condensed steam or condensate from the digester can be routed to the chip washer, block 102.

The pulp is next conveyed from the separator through a screw conveyor, represented by block 110, into a peroxide bleaching tower, represented by block 112. The pH of the contents in the peroxide bleaching tower is above 7 to about 9. The pulp continues to undergo the bleaching reaction with the magnesium ions, hydroxyl ions, and perhydroxyl ions in the peroxide tower for an additional retention period of about 45 minutes to about 120 minutes, depending on the desired final pulp brightness. The pulp can be diluted at the bottom of the tower for the purpose of facilitating pumping the pulp out of the tower. The pulp leaving the peroxide tower ends up having a consistency of about 4% to about 6%. The dilution of the pulp to this low consistency will slow the bleaching reaction to essentially zero. In other embodiments of the invention, it is possible to provide the bleaching tower after the secondary refiner, or if there are more than two refiners, the bleaching tower can be provided after the last refiner. In these alternate embodiments, the source of magnesium and hydroxyl ions and the source of perhydroxyl ions can be added to the towers.

The pulp next enters a dewatering operation, represented by block 114. A screw press is a suitable apparatus to dewater the pulp at this stage. The screw press elevates the consistency of the pulp back to about 25% to about 35%.

From the screw press, the pulp enters a secondary refiner, represented by block 116. In one embodiment, the secondary refiner can be operated at atmospheric pressure. Alternatively, the secondary refiner can be operated at a pressure greater than atmospheric pressure. The load on the secondary refiner is about 500 to about 2000 kilowatt-hours per ton. The pulp leaves the secondary refiner having a Canadian Standard Freeness value of about 80 to about 200. The consistency of the pulp leaving the secondary refiner is about 15% to about 50%.

The pulp leaving the secondary refiner can enter a dilution chest, represented by block 118, wherein the consistency of the pulp is reduced to about 4% to about 6%, before the pulp is cleaned up.

From the dilution chest, the pulp can be screened in one or a plurality of screening devices to remove any oversized fibers which can then be routed for further refining into any one of the refiners, preferably the secondary refiner. The screening operation can reduce the consistency of the pulp to as low as about 2%.

After the screening process, the pulp enters a "decker" operation. A decker is an apparatus that further separates water from the screened pulp to provide the desired consistency. The typical pulp consistency leaving the decker is about 6% to about 12%. The pulp produced according to the invention leaving the decker can have a Canadian Standard Freeness value of about 60 to about 200 and an ISO brightness of about 50 to about 75 or greater. The brightness achieved by hydrogen peroxide bleaching using magnesium oxide/hydroxide/water is comparable to using sodium hydroxide/sodium silicate without the drawbacks of sodium hydroxide/sodium silicate and with no impact on bleaching efficiency. It is possible to provide the source of magnesium ions and hydroxyl ions and the source of perhydroxyl ions to the decker.

The pulp product leaving the decker can be stored in any storage vessel, represented by block 124. The pulp can be somewhat diluted in the high-density storage tanks to a consistency of about 4% to about 6% before being sent to the paper machines, represented by block 126.

It has been discovered that peroxide bleaching with magnesium hydroxide has advantages over the conventional peroxide bleaching with sodium hydroxide/sodium silicate. Magnesium oxide typically comes as a powder. Magnesium oxide powder is only slightly soluble in water. For use in the methods according to the present invention, the magnesium oxide powder can be mixed with water to provide a slurry. Magnesium oxide (MgO) when mixed with water results in magnesium hydroxide ($Mg(OH)_2$), which in turn supplies the magnesium ions and the hydroxyl ions, needed for the generation of the perhydroxyl ions from hydrogen peroxide ($H_2O_2$). Magnesium oxide/hydroxide/water slurry, block 130, can be provided to any one or more refiners, either with the wood chips or in the pulp leading to the refiner, or at the refiner, such as at the eye of the refiner. Magnesium oxide/hydroxide/water slurry, block 130, can be provided to mixers, plug wipers, bleaching towers, and deckers, for example. Hydrogen peroxide addition, block 132, can occur at the same injection locations as magnesium oxide/hydroxide/water slurry injection. Magnesium oxide/hydroxide/water slurry injection can occur separately or concurrently with hydrogen peroxide injection. If magnesium oxide/hydroxide/water slurry injection is carried out separately in the primary refiner, the hydrogen peroxide can be injected before or after the refiner, or at the bleaching tower. Alternatively, hydrogen peroxide injection can take place with the magnesium slurry injection before or at the refiner. This manner of magnesium oxide/hydroxide/water slurry and hydrogen peroxide injection can take place in any other refiner or ancillary vessel, either separately or concurrently. The amount of magnesium oxide that is used in any one refiner or vessel is about 0.75% to about 2% based on the oven dried weight of the wood, and undiluted 100% magnesium oxide. The addition of hydrogen peroxide that is used in any one refiner or vessel is about 1% to about 12% based on the oven dried weight of wood, and undiluted 100% hydrogen peroxide.

Chelating agents or chelants, block 128, may be added to the pulp prior to refining in the primary refiner, such as at the plug wiper. The amount of chelant added can be about 0.1% to about 0.5% based on the oven dried weight of wood and undiluted 100% chelant. Suitable chelating agents include, but are not limited to, amino polycarboxylic acids (APCA), ethylenediamenetetraacetic acid (EDTA), diethylenetriaminepentaacetic acid (DTPA), nitrilotriacetic acid (NTA), phosphonic acids, ethylenediaminetetramethylenephosphonic acid (EDTMP), diethylenetriaminepentamethylenephosphonic acid (DTPMP), nitrilotrimethylenephosphonic acid (NTMP), polycarboxylic acids, gluconates, citrates, polyacrylates, and polyaspartates, or any combination thereof. Chelating agents are useful to bind metals to prevent the decomposition of hydrogen peroxide. In addition to chelating agents, the pulp can also be provided with bleaching aids.

EXAMPLE

Experimental work was carried out to demonstrate the benefits of hydrogen peroxide bleaching with magnesium hydroxide as compared with sodium hydroxide/sodium silicate in a series of bleaching tests where a temporary equipment setup was used to supply chemicals to a commercial refiner. In this example, a pressurized mechanical double disk refiner was used, however, other pressurized and atmospheric high consistency refiners will give similar results. The chemical application process and testing is described below. The results using magnesium hydroxide were compared to historical production data that used sodium hydroxide/sodium silicate from the same refiner and test equipment.

Wood chips were processed at the rate of 7 tons/hr through the chip washer and digester shown in FIG. 1. The chips were fed to the feeder where chelants like DTPA were added at the rate of 3 lbs/ton. Plug wiper water was added to control consistency. Before the addition of the plug wiper water, a 60% slurry solution of magnesium hydroxide was mixed with the plug wiper water. The amount of slurry varied depending on the brightness target and the amount of hydrogen peroxide added. For a brightness target of 60 points, the amount of magnesium hydroxide might be 25 lbs/ton (of wood) on a dry weight basis. The amount of hydrogen peroxide might be 50 lbs/ton or 2.5% of wood. Chemical charge will vary due to normal process variation like raw chip brightness.

A 40% hydrogen peroxide solution was pumped with a variable speed gear pump to the chip feeder. A flow meter was installed ahead of the refiner to control the bleaching chemical added to the wood chips. Hydrogen peroxide was added to the refiner through one of the plug wiper nozzles. The location of the chemical injection nozzle was near the eye of the refiner. The hydrogen peroxide can also be added to the plug wiper water either before or after the magnesium hydroxide slurry has been added. The amount of hydrogen peroxide was varied and the bleached pulp was sampled from the blowline directly downstream of the refiner. The bleached samples were placed in sample bags and held in a hot water bath for 1 hour at 180° F. The sample was then tested in equipment known under the designation "Pulp Expert" from Metso Inc. The same bleaching times and test equipment were used with magnesium hydroxide as with sodium hydroxide/sodium silicate to enable comparison of the two processes. Currently, sodium hydroxide/sodium silicate and hydrogen peroxide are added after the refiner (post-refiner) and the pulp is held in a bleach tower for 1 hour.

Figure 2:
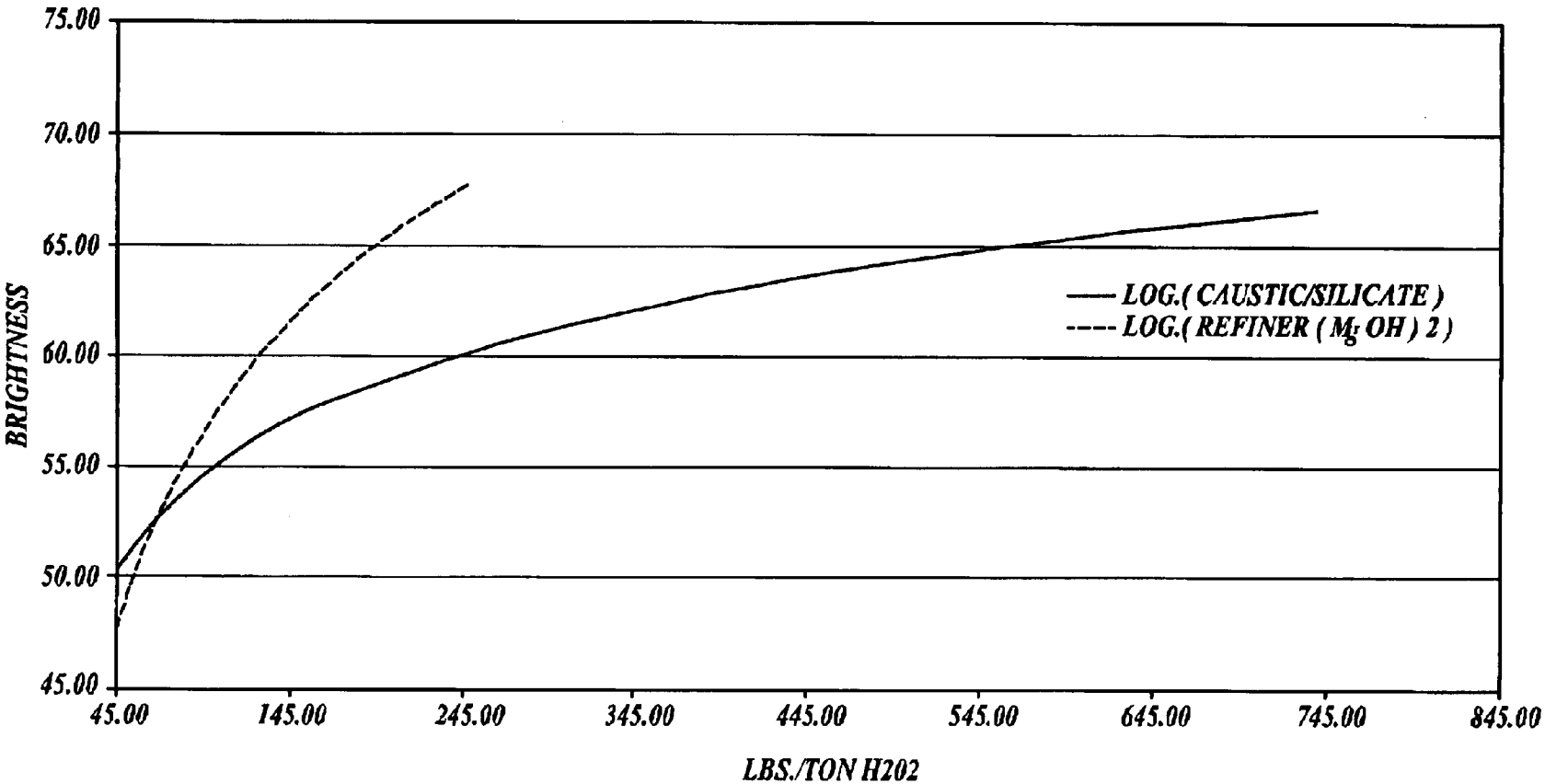
FIG. 2 is a graphical representation of the brightness versus hydrogen peroxide usage comparing a process using magnesium hydroxide at the refiner with a process using sodium hydroxide and sodium silicate chemicals.

The brightness results of the refiner bleached pulps with magnesium hydroxide and the post-refiner bleached pulps with sodium hydroxide and silicate are shown in FIG. 2. The addition of hydrogen peroxide to the eye of the primary refiner improved bleaching efficiency by over 25% to 50% on the low brightness grades (52–60) and over 60% efficiency on the high brightness grades (65+). Visual observation from the refiner confirmed that the bleached pulp was extremely homogenous in comparison to the bleach application at the top of the tower. Adding hydrogen peroxide to the refiner prevented alkali darkening which also improved bleach efficiency. Using multiple stages of refiner bleaching with magnesium hydroxide will allow much higher brightness levels to be achieved.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of bleaching pulp, comprising:

(a) introducing a source of magnesium ions and hydroxyl ions to a refiner;

(b) introducing a source of perhydroxyl ions to said refiner; and (c) refining wood particulates into pulp in said refiner.

2. The method of claim 1, wherein the source of said magnesium ions and hydroxyl ions is a slurry of magnesium oxide and water.

3. The method of claim 1, wherein the source of magnesium ions and hydroxyl ions is added to the wood particulates prior to the refiner to thereby introduce said source of magnesium ions and hydroxyl ions to said refiner.

4. The method of claim 1, wherein the source of magnesium ions and hydroxyl ions is added directly at the refiner to thereby introduce said source of magnesium ions and hydroxyl ions to said refiner.

5. The method of claim 1, wherein the refiner is a primary refiner in a two- or multi-stage refining system.

6. The method of claim 1, wherein a chelating agent is added to the wood particulates prior to the refiner.

7. The method of claim 1, wherein the refiner is a secondary refiner in a two-stage refining system.

8. The method of claim 1, wherein the source of perhydroxyl ions is hydrogen peroxide.

9. The method of claim 1, wherein the source of perhydroxyl ions is added to the wood particulates prior to the refiner to thereby introduce said source of perhydroxyl ions to said refiner.

10. The method of claim 1, wherein the source of perhydroxyl ions is added directly at the refiner to thereby introduce said source of perhydroxyl ions to said refiner.

11. The method of claim 1, further comprising retaining said pulp within a vessel after refining for about 45 to about 120 minutes.

12. The method of claim 11, further comprising introducing a source of perhydroxyl ions to said vessel.

13. The method of claim 12, further comprising refining said pulp in a secondary refiner after retention in the vessel.

14. The method of claim 13, wherein a source of magnesium ions and hydroxyl ions is added to said secondary refiner.

15. The method of claim 14, wherein a source of perhydroxyl ions is added to said secondary refiner.

16. The method of claim 1, wherein said pulp is a mechanical pulp.

17. The method of claim 1, wherein said pulp is a chemical pulp.

18. The method of claim 1, wherein said pulp is a recycled pulp.

19. The method of claim 1, wherein said pulp has a consistency of about 3% to about 20%.

20. The method of claim 1, wherein said pulp has a consistency of about 15% to about 50%.

21. The method of claim 1, wherein the refiner is a low to medium consistency refiner.

22. A method of bleaching mechanical pulp in a two-stage refiner system, comprising:

(a) introducing a source of magnesium ions and hydroxyl ions to a primary refiner;

(b) refining wood particulates into pulp in said primary refiner;

(c) retaining said refined pulp within a vessel after primary refining for about 45 to about 120 minutes;

(d) introducing a source of perhydroxyl ions to said vessel; and (e) refining said pulp in a secondary refiner after retention in said vessel to produce a bleached mechanical pulp.

23. The method of claim 22, further comprising introducing a source of perhydroxyl ions to the primary refiner.

24. The method of claim 22, further comprising introducing a source of magnesium ions and hydroxyl ions to the secondary refiner.

25. The method of claim 22, further comprising introducing a source of perhydroxyl ions to the secondary refiner.

26. The method of claim 22, wherein the bleached mechanical pulp has an ISO brightness value of about 50 to about 75 or greater.

27. The method of claim 22, wherein the bleached mechanical pulp has a Canadian Standard Freeness value of about 60 to about 200.

* * * * *